US006578955B2

(12) United States Patent
Furlani et al.

(10) Patent No.: US 6,578,955 B2
(45) Date of Patent: Jun. 17, 2003

(54) CONTINUOUS INKJET PRINTER WITH ACTUATABLE VALVES FOR CONTROLLING THE DIRECTION OF DELIVERED INK

(75) Inventors: Edward P. Furlani, Lancaster, NY (US); Christopher N. Delametter, Rochester, NY (US); John A. Lebens, Rush, NY (US); Ravi N. Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 56 days.

(21) Appl. No.: 09/981,281

(22) Filed: Oct. 17, 2001

(65) Prior Publication Data

US 2003/0071880 A1 Apr. 17, 2003

(51) Int. Cl.[7] ..... B41J 2/105
(52) U.S. Cl. ..... 347/82
(58) Field of Search ..... 347/82, 85, 77, 347/73, 20

(56) References Cited

U.S. PATENT DOCUMENTS

| | | | | |
|---|---|---|---|---|
| 1,941,001 A | | 12/1933 | Hansell | 178/96 |
| 3,373,437 A | | 3/1968 | Sweet et al. | 347/74 |
| 3,878,519 A | | 4/1975 | Eaton | 347/75 |
| 4,346,387 A | | 8/1982 | Hertz | 347/75 |
| 5,969,736 A | * | 10/1999 | Field et al. | 347/85 |
| 6,341,852 B1 | * | 1/2002 | Yamamoto | 347/10 |

OTHER PUBLICATIONS

Furlami et al, Surface Tension Instability of Viscous Liquid Jets, Proceedings of the Fourth International Conference on Modeling and Simulation of Microsystems, Applied Computational Research Society, Cambridge MA., 186, 2001.

* cited by examiner

*Primary Examiner*—Lamson Nguyen
*Assistant Examiner*—K. Feggins
(74) *Attorney, Agent, or Firm*—Raymond L. Owens

(57) ABSTRACT

Apparatus for controlling ink in a continuous inkjet printer. A nozzle element defining an ink staging chamber and having a nozzle bore in communication with the ink staging chamber arranged so as to establish a continuous flow of ink in a ink stream; ink delivery means intermediate the reservoir and the ink staging chamber for communicating ink between the reservoir and defining first and second spaced ink delivery channels; a first actuable flow delivery valve positioned in operative relationship with the first ink delivery channel and a second actuable flow delivery valve positioned in operative relationship with the second ink delivery channel; and the valves are controlled to control the path along which ink is delivered through the nozzle.

6 Claims, 6 Drawing Sheets

CONTINUOUS INKJET PRINTER WITH ACTUATABLE VALVES FOR CONTROLLING THE DIRECTION OF DELIVERED INK

CROSS REFERENCE TO RELATED APPLICATION

Reference is made to commonly-assigned U.S. patent application Ser. No. 09/468,987 filed Dec. 21, 1999 entitled "Continuous Ink Jet Printer With Micro-Valve Deflection and Method of Making Same" by Lebens et al, the disclosure of which is incorporated herein.

FIELD OF THE INVENTION

This invention relates to continuous inkjet printheads which integrate multiple nozzles on a single substrate and in which print nonprint operation is effected by controlled deflection of the ink as it leaves the printhead nozzle.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and inkjet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Inkjet printing has become recognized as a prominent contender in the digitally controlled, electronic printing arena because, e.g., of its non-impact, low-noise characteristics, its use of plain paper and its avoidance of toner transfers and fixing. Inkjet printing mechanisms can be categorized as either continuous inkjet or drop on demand inkjet. Continuous inkjet printing dates back to at least 1929. See U.S. Pat. No. 1,941,001 to Hansell.

U.S. Pat. No. 3,373,437, which issued to Sweet et al. in 1967, discloses an array of continuous inkjet nozzles wherein ink drops to be printed are selectively charged and deflected towards the recording medium. This technique is known as binary deflection continuous inkjet, and is used by several manufacturers, including Elmjet and Scitex.

U.S. Pat. No. 3,416,153, which issued to Hertz et al. in 1966, discloses a method of achieving variable optical density of printed spots in continuous inkjet printing using the electrostatic dispersion of a charged drop stream to modulate the number of droplets which pass through a small aperture. This technique is used in inkjet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging rings, deflection plates are used to deflect the drops.

Conventional continuous inkjet utilizes electrostatic charging rings that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. In the current invention, the electrostatic tunnels and charging plates are unnecessary.

SUMMARY OF THE INVENTION

It is an object of the present invention to provide a high-speed continuous inkjet apparatus whereby drop deflection may occur at high repetition.

It is another object of the present invention to provide a high-speed continuous inkjet apparatus whereby drop formation and deflection may occur at high repetition.

These objects are achieved in an apparatus for controlling ink in a continuous inkjet printer in which a continuous stream of ink is emitted from a nozzle bore; the apparatus comprising:

a reservoir containing pressurized ink;

a nozzle element defining an ink staging chamber and having a nozzle bore in communication with the ink staging chamber arranged so as to establish a continuous flow of ink in an ink stream;

ink delivery means intermediate the reservoir and the ink staging chamber for communicating ink between the reservoir and defining first and second spaced ink delivery channels;

a first actuable flow delivery valve positioned in operative relationship with the first ink delivery channel and a second actuable flow delivery valve positioned in operative relationship with the second ink delivery channel; and means for selectively actuating the first and second actuable flow delivery valves so that when both first and second actuable flow delivery valves are unactuated ink is delivered through the nozzle along a first path and when the first actuable flow delivery valve is actuated and the second actuable flow delivery valve is unactuated, ink is delivered through the nozzle along a second path and when the second actuable flow delivery valve is actuated and the first actuable flow delivery valve is unactuated, ink is delivered through the nozzle along a third path wherein the first, second and third paths are spaced from each other These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
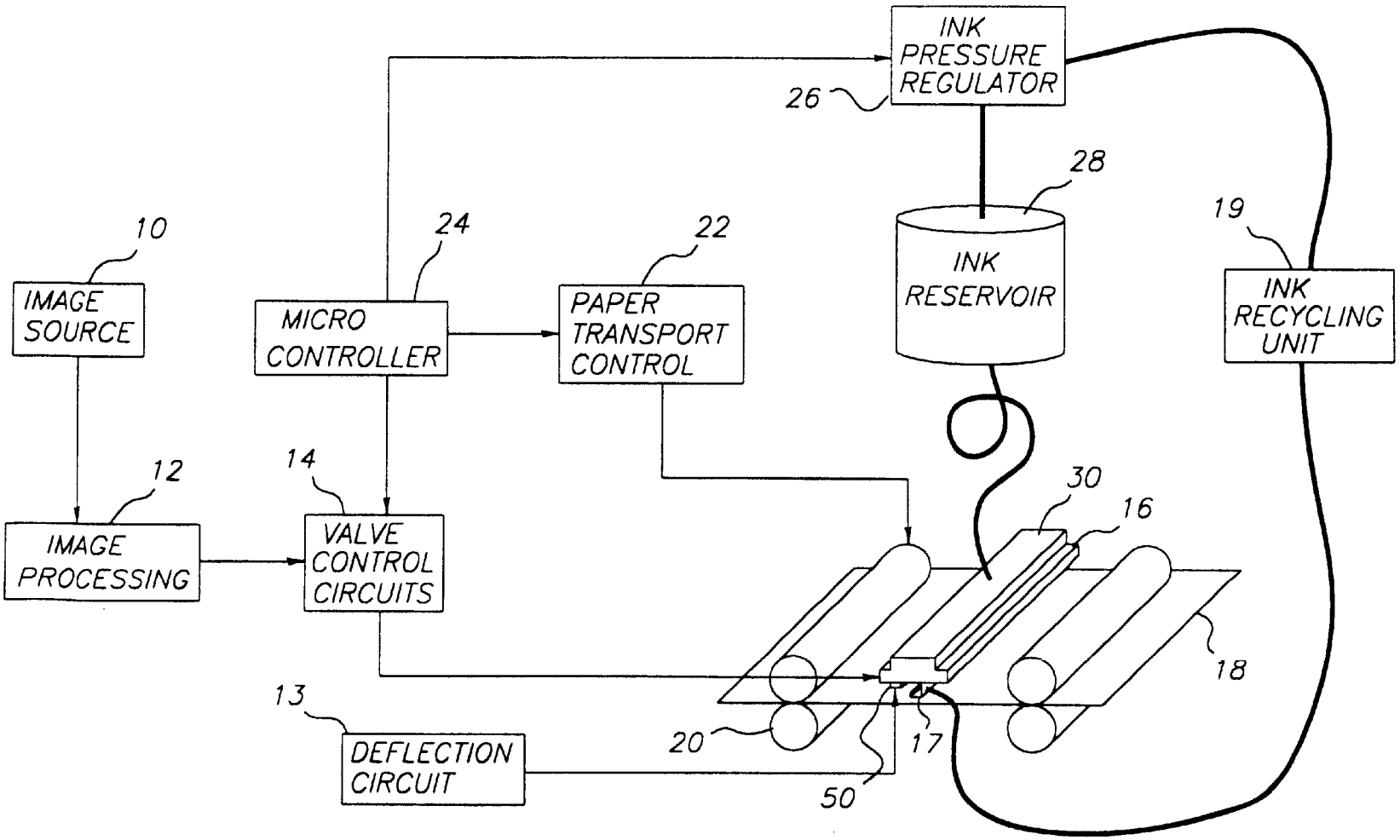
FIG. 1 shows a simplified block schematic diagram of one exemplary printing apparatus according to the present invention.

Referring to FIG. 1, a continuous inkjet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. The image processing unit applies control signals 13 to a plurality of valve control circuits 14 which, in turn, apply time-varying electrical pulses to a set of electrically controlled valves and heater circuitry that are part of a printhead 16. These pulses are applied at an appropriate time, and to the appropriate nozzle in the printhead 16, so that drops formed from a continuous inkjet stream will form spots on a recording medium 18 in the appropriate position designated by the data in the image memory.

Recording medium 18 is moved relative to printhead 16 by a recording medium transport system 20, and which is electronically controlled by a recording medium transport control system 22, which in turn is controlled by a micro-controller 24. The recording medium transport system 20 shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along the orthogonal axis (the main scanning direction) in a relative raster motion.

Micro-controller 24 may also control an ink pressure regulator 26 and valve control circuits 14. Ink is contained in an ink reservoir 28 under pressure. The pressure can be applied in any convenient manner such as by using a standard air compressor. In the non-printing state, continuous inkjet drop streams are unable to reach recording medium 18 due to an ink gutter 17 that blocks the stream and which may allow a portion of the ink to be recycled by an ink recycling unit 19. The ink recycling unit 19 reconditions the ink and feeds it back to ink reservoir 28. Such ink recycling units 19 are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface, where a plurality of nozzles and heaters are situated. With printhead 16 fabricated from a silicon substrate, it is possible to integrate valve control circuits 14 with the printhead 16.

Figure 2:
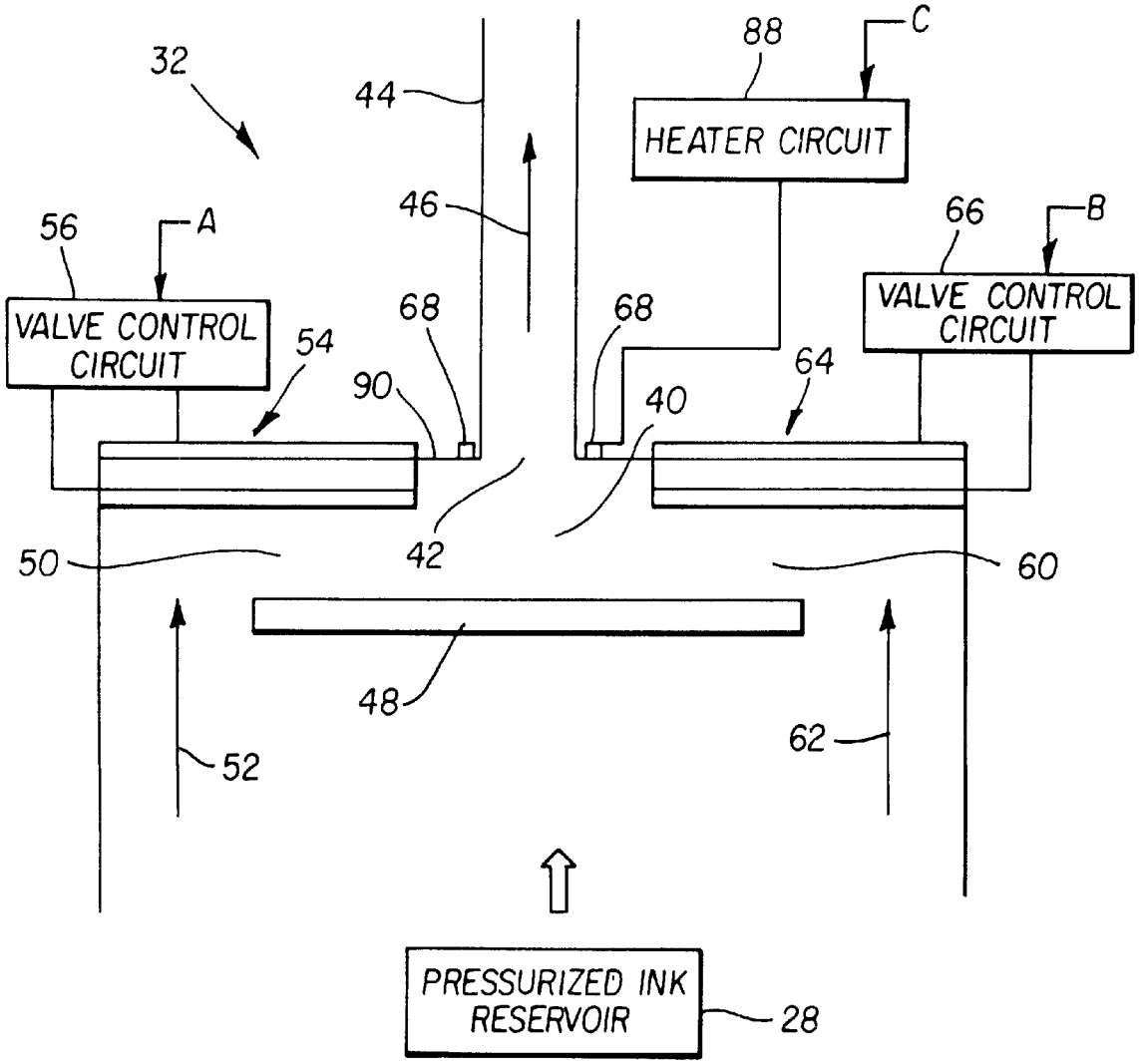
FIG. 2 shows in schematic form a cross-section of a segment of a continuous inkjet printhead illustrating the inkjet flow through a nozzle element with the nozzle element in an unactuated state and the inkjet flow along a first path.

Turning to FIG. 2, a segment of printhead 16 is shown schematically in cross-section illustrating the inkjet flow through a nozzle element 32 with the nozzle element 32 in an unactuated state. Each nozzle element 32 includes an ink staging chamber 40 having a nozzle bore 42 from which ink under pressure is emitted in the form of an ink jet 44 in a first direction which is indicated by flow arrow 46. The pressurized ink from reservoir 28 is communicated to the ink staging chamber 40 by ink channel device 30. The inkjet nozzle element 32 further includes an ink delivery means which includes a dividing wall 48 which defines a first ink delivery channel 50 and a second ink delivery channel 60. The direction of ink flow through the first ink delivery channel 50 is indicated by flow arrow 52 and the flow is controlled by a first actuable flow delivery valve 54. The direction of ink flow through the second ink delivery channel 60 is indicated by flow arrow 62 and the flow is controlled by a second actuable flow delivery valve 64. The first actuable flow delivery valve 54 is controlled by a first valve control circuit 56, and the second actuable flow delivery valve 64 is controlled by a second valve control circuit 66 as described below. The first and second valve control circuits 56 and 66 receive control signals from the valve control circuits 14 (FIG. 1) as shown. Each nozzle element 32 further includes a heater element 68 which surrounds the nozzle 32. The heater element 68 is activated by a heater circuit 88.

Figure 3A:
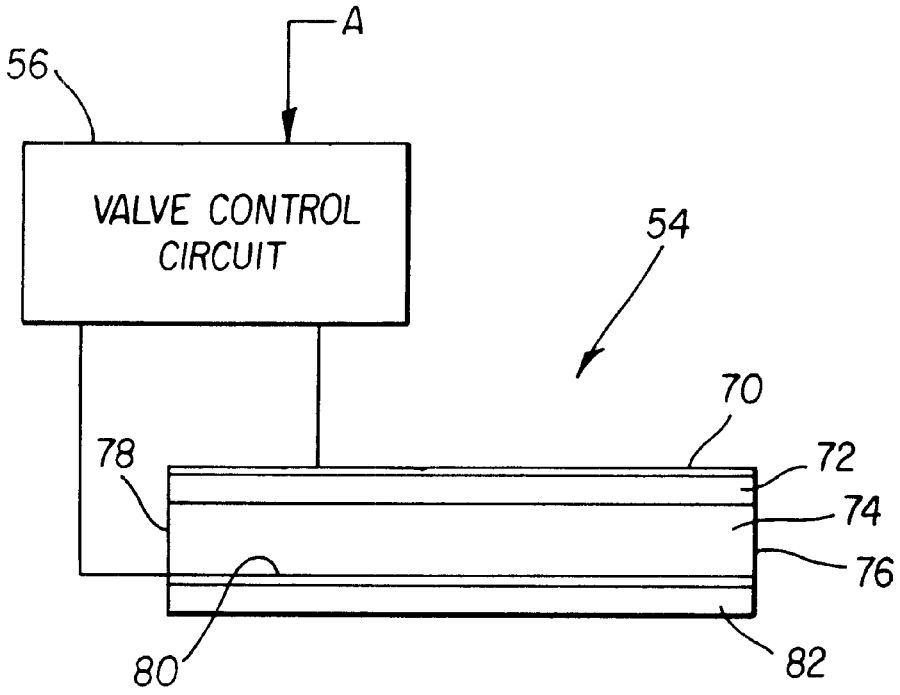
FIGS. 3*a* and 3*b* illustrate cross sectional views of an actuable flow delivery valve in an unactivated and activated state, respectively.
Figure 3B:
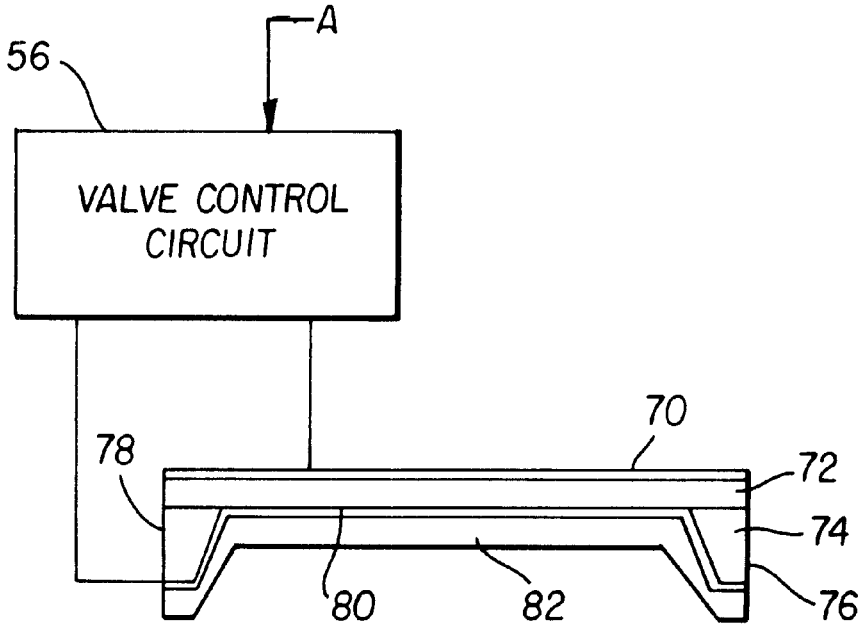

FIGS. 3*a* and 3*b* illustrate cross sectional views of the first actuable flow delivery valve 54 in an unactivated and activated state, respectively. Referring to FIG. 3*a,* the first actuable flow delivery valve 54 includes a top electrode 70, a top plate 72, a gap 74, side walls 76 and 78, a bottom electrode 80 and a bottom plate 82. The top and bottom electrodes 70 and 80 are fixedly attached to the top and bottom plates 72 and 82, respectively. Furthermore, the top plate 72 is fixedly attached to the stationary nozzle plate 90 (FIG. 2). The bottom plate 82 is supported at its ends by walls 76 and 78 and is free to bend and flex as described below. The top and bottom plates 72 and 82 are made from nonconductive material. The gap 74 is enclosed by the top plate 72, the side walls 76 and 78, and the bottom plate 82. The gap 74 is sealed by its surrounding structure and may contain air or other gases at a specified pressure. The first valve control circuit 56 controls the first actuable flow delivery valve 54. In the unactivated state there is no voltage applied between the top and bottom electrodes 70 and 80 and consequently the top and bottom plates 72 and 82 are parallel to one another along the entire length of the gap 74. The second actuable flow delivery valve 64 and the second valve control circuit 66 are substantially the same as the first actuable flow delivery valve 54 and the first valve control circuit 56, respectively. Therefore, the same numbers are used to identify the like components of these elements.

FIG. 3*b* depicts the first actuable flow delivery valve 54 in an activated state. To activate the first actuable flow delivery valve 54, the first valve control circuit 56 applies a voltage between the top electrode 70 and bottom electrode 80. The first valve control circuit 56 receives control signals from the valve control circuits 14 (FIG. 1). The voltage applied by the first valve control circuit 56 creates an electrostatic force between the two electrodes as is well known. This force causes the bottom plate 82 to deflect upward into the gap 74 as shown. When the voltage is turned off, the first actuable flow delivery valve 54 returns to its unactivated state as shown in FIG. 3a. The operation of the second actuable flow delivery valve 64 and the second valve control circuit 66 is substantially the same as the first actuable flow delivery valve 54 and the first valve control circuit 56.

Figure 4:
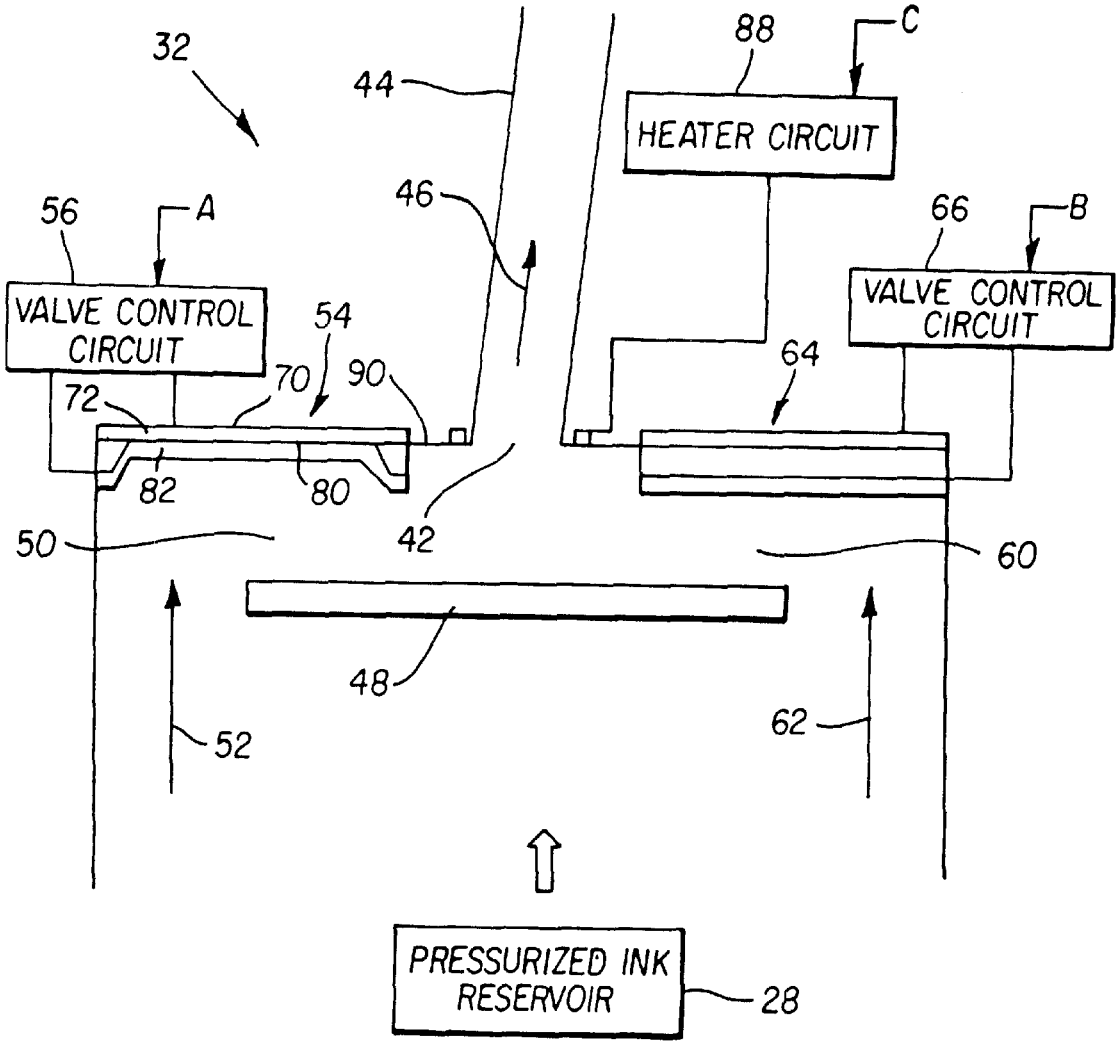
FIG. 4 shows in schematic form a cross-section of a segment of continuous inkjet printhead illustrating the inkjet flow through a nozzle element with the nozzle element in a first actuated state and the inkjet flow along a second path.

FIG. 4 shows in schematic form a cross-section of a segment of continuous inkjet printhead 16 illustrating the ink flow through a nozzle element 32 with the nozzle element 32 in a first actuated state. In the first actuated state the first valve control circuit 56 applies a voltage between the top electrode 70 and bottom electrode 80 of the first actuable flow delivery valve 54. The first valve control circuit 56 receives control signals from the valve control circuits 14 (FIG. 1). The voltage applied by the first valve control circuit 56 creates an electrostatic force between the two electrodes 70 and 80 of the second actuable flow delivery valve 64 and this force causes the bottom plate 82 to deflect upward into the gap 74 as shown. When the first actuable flow delivery valve 54 is activated the ink flow through the first ink delivery channel 50 is greater that the ink flow through the second ink delivery channel 60. This is illustrated by the bold flow arrow 52 as compared to the nonbold flow arrow 62. Because the ink flow through the first ink delivery channel 50 is greater than the ink flow through the first ink delivery channel 60 the jet 44 that forms from the nozzle element 32 is tilted away from the first ink delivery channel 50 and toward the second ink delivery channel 60 along a second path as indicated by flow arrow 46. Therefore, by actuating the first actuable flow delivery valve 54 with the second actuable flow delivery valve 64 unactuated the jet 44 can be directed away from the recording medium 18 toward the ink gutter 17 or vice versa.

Figure 5:
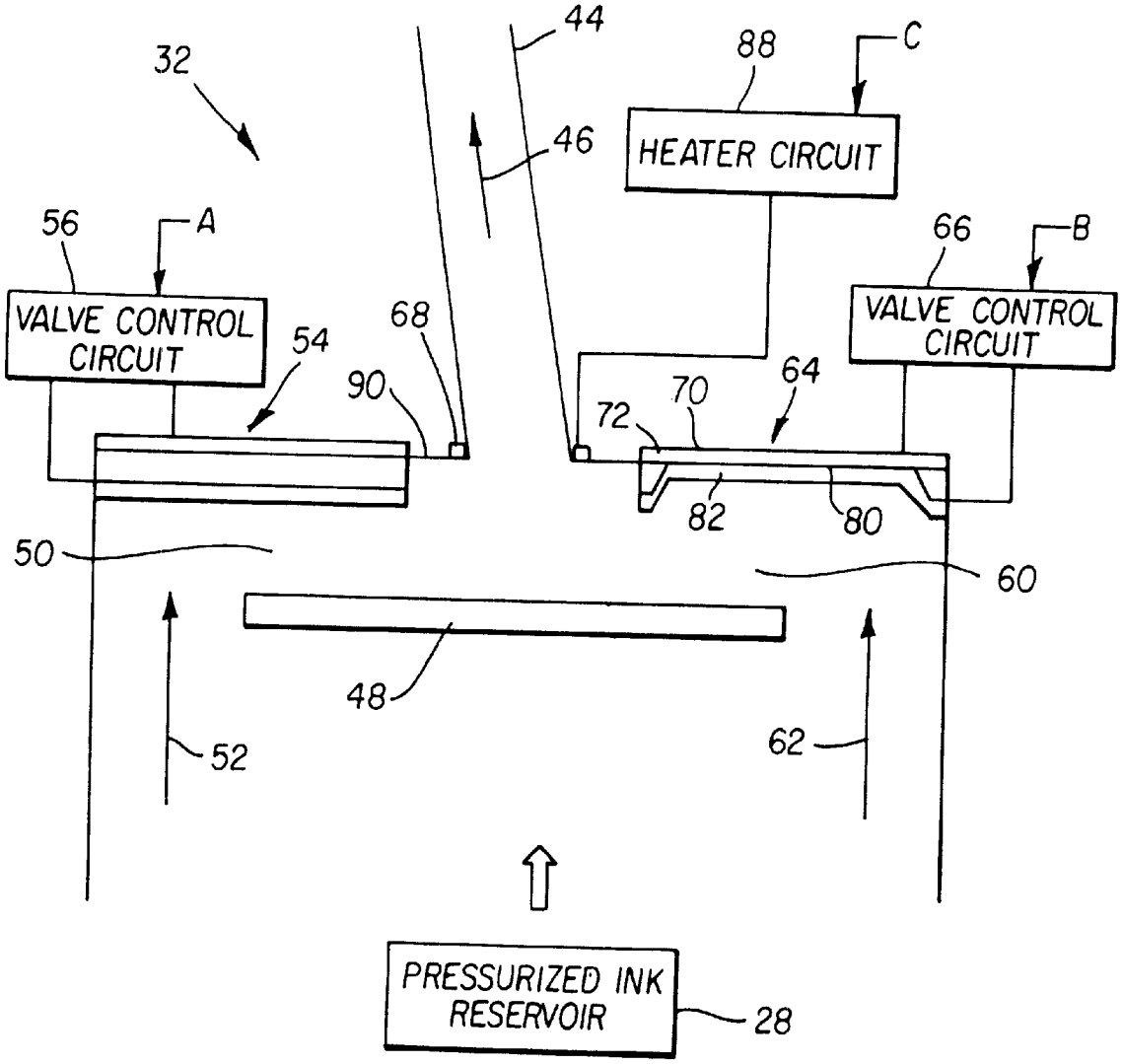
FIG. 5 shows in schematic form a cross-section of a segment of continuous inkjet printhead illustrating the inkjet flow through a nozzle element with the nozzle element in a second actuated state and the inkjet flow along a third path.

FIG. 5 shows in schematic form a cross-section of a segment of continuous inkjet printhead 16 illustrating the ink flow through a nozzle element 32 with the nozzle element 32 in a second actuated state. In the second actuated state the second valve control circuit 66 applies a voltage between the top electrode 70 and bottom electrode 80 of the second actuable flow delivery valve 64. The second valve control circuit 66 receives control signals from the valve control circuits 14 (FIG. 1). The voltage applied by the second valve control circuit 66 creates an electrostatic force between the top and bottom electrodes 70 and 80 of the second actuable flow delivery valve 64 and this causes the bottom plate 82 to deflect upward into the gap 74 as shown. When the second actuable flow delivery valve 64 is activated the ink flow through the second ink delivery channel 60 is greater that the ink flow through the first ink delivery channel 50. This is illustrated by the bold flow arrow 62 as compared to the nonbold flow arrow 52. Because the ink flow through the second ink delivery channel 60 is greater than the ink flow through the first ink delivery channel 50 the jet 44 that forms from the nozzle element 32 is lilted away from the second ink delivery channel 60 and toward the first ink delivery channel 50 along a third path as indicated by flow arrow 46. Therefore, by actuating the second actuable flow delivery valve 64 with the first actuable flow delivery valve 54 unactuated the jet 44 can be directed away from the recording medium 18 toward the ink gutter 17 or vice versa.

Figure 6:
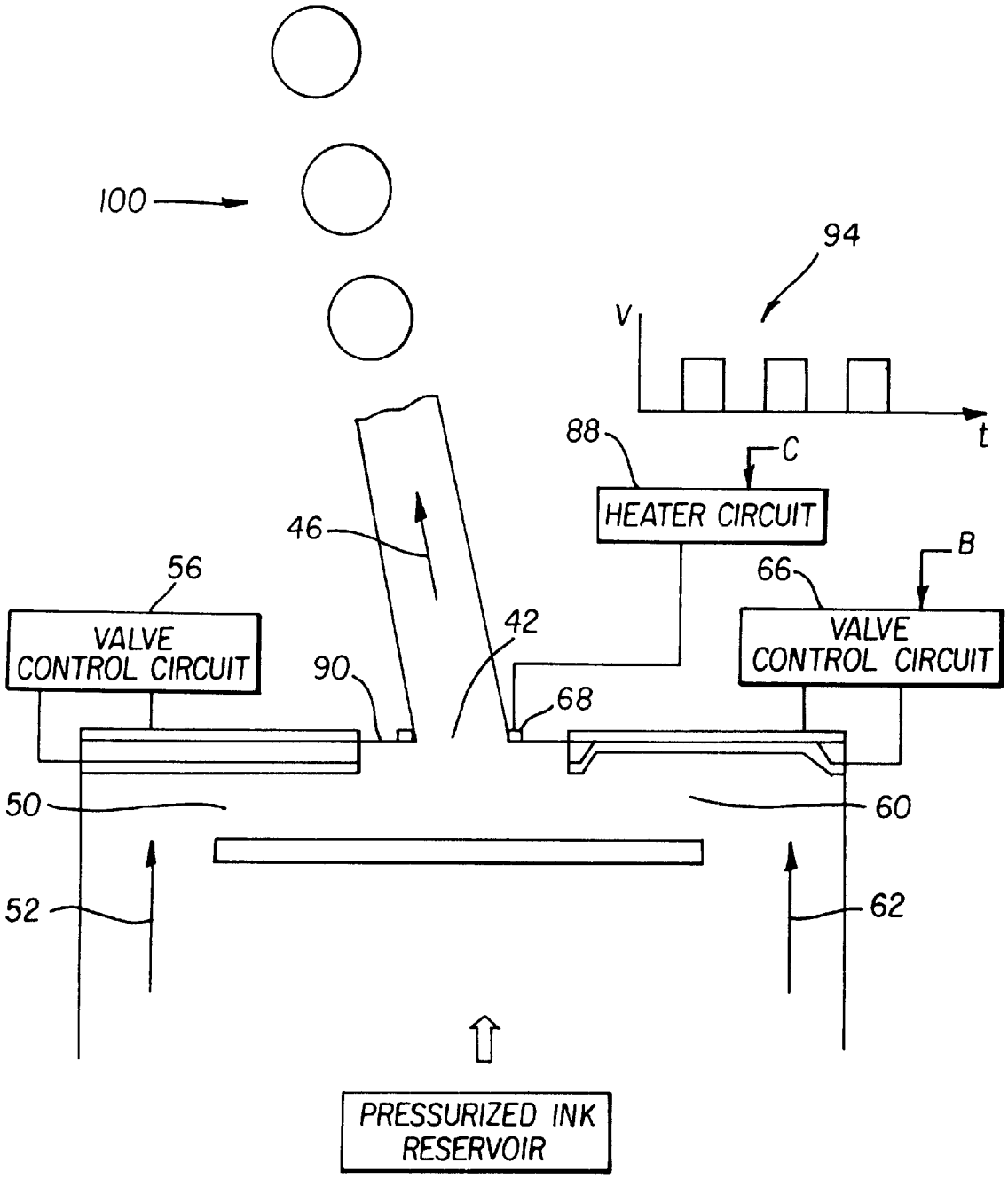
FIG. 6 shows in schematic form a cross-section of a segment of continuous inkjet printhead illustrating the inkjet flow along a second path wherein the inkjet is subjected to a thermal modulation which induces drop formation.

FIG. 6 shows in schematic form a cross-section of a segment of continuous inkjet printhead 16 illustrating the inkjet flow along a second path with the inkjet 44 subjected to a thermal modulation which causes drop formation. Specifically, the inkjet 44 is heated as it leaves the nozzle bore 42 via heater element 68. Heater element 68 includes a continuous strip of electrically conductive material fixedly attached to the nozzle plate 90 and substantially surrounding the nozzle bore 42 with two spaced apart ends that serve as electrical terminals. To activate the heater element 68, a voltage is applied to its terminals and current flows through it causing ajoule heating as is well known. The voltage through the heater element 68 is supplied by the heater circuit 88 which receives control signals from the valve control circuit 14 (FIG. 1). The voltage supplied by the heater circuit 88 is typically in the form of a sequence of voltage pulses 94. The magnitude and duration of the voltage pulses 94 are chosen to cause the inkjet 44 to break into drops 100 in a predicable fashion. Specifically, the heater element 68 heats the surface of the inkjet 44 as it leaves the nozzle bore 42 and causes variation of the surface tension of inkjet 44 which, in turn, stimulates drop formation as described by Furlani et al "Surface Tension Induced Instability of Viscous Liquid Jets," Proceedings of the Fourth International Conference on Modeling and Simulation of Microsystems, Applied Computational Research Society, Cambridge Mass., 186, 2001. Thus, when the inkjet 44 is directed toward the recording medium 18 the thermal modulation due to heater element 68 will cause ink spots to form on the recording medium 18 in the appropriate position designated by the data in the image memory.

The invention has been described in detail with particular reference to certain preferred embodiments thereof, but it will be understood that variations and modifications can be effected within the spirit and scope of the invention.

PARTS LIST

10 image source
12 image processing unit
13 control signals
14 valve control circuits
16 printhead
17 ink gutter
18 recording medium
19 ink recycling unit
20 recording medium transport system
22 transport control system
24 micro-controller
26 ink pressure regulator
28 ink reservoir
30 ink channel device
32 nozzle element
40 ink staging chamber
42 nozzle bore
44 ink jet
46 flow arrow
48 dividing wall
50 first ink delivery channel
52 flow arrow
54 first actuable flow delivery valve
56 first valve control circuit

60 second ink delivery channel
62 flow arrow
64 second actuable flow delivery valve
66 second valve control circuit
Part List Cont'd
69 heater element
70 top electrode
72 top plate
74 gap
76 side wall
78 side wall
80 bottom electrode
82 bottom plate
88 heater circuit
90 stationary nozzle plate
94 voltage pulses
100 ink drops

What is claimed is:

1. Apparatus for controlling ink in a continuous inkjet printer in which a continuous stream of ink is emitted from a nozzle bore; the apparatus comprising:

a reservoir containing pressurized ink;

a nozzle element defining an ink staging chamber and having a nozzle bore in communication with the ink staging chamber arranged so as to establish a continuous flow of ink in a ink stream;

ink delivery means intermediate the reservoir and the ink staging chamber for communicating ink between the reservoir and defining first and second spaced ink delivery channels;

a first actuable flow delivery valve positioned in operative relationship with the first ink delivery channel and a second actuable flow delivery valve positioned in operative relationship with the second ink delivery channel; and means for selectively actuating the first and second actuable flow delivery valves so that when both first and second actuable flow delivery valves are unactuated ink is delivered through the nozzle along a first path and when the first actuable flow delivery valve is actuated and the second actuable flow delivery valve is unactuated, ink is delivered through the nozzle along a second path and when the second actuable flow delivery valve is actuated and the first actuable flow delivery valve is unactuated, ink is delivered through the nozzle along a third path wherein the first, second and third paths are spaced from each other.

2. The apparatus of claim 1 wherein the first and second actuable flow delivery valves each includes spaced electrodes wherein one of the electrodes is movable and the selective actuating means applies an electric field between the electrodes which causes the movement of at least one electrode to selectively change the flow volume in the first and second delivery channels, respectively.

3. The apparatus of claim 1 wherein the selective actuating means includes image processing means responsive to an image for producing control signals, a valve control circuit associated with the first and second actuable flow delivery valves respectively so that the control signals are selectively applied to the first and second actuable flow delivery valves.

4. The apparatus of claim 1 further including heating means associated with the nozzle for heating the ink to cause drops to form so that such drops are deliverable along the first, second or third paths.

5. The apparatus of claim 1 further including a dividing wall spaced from the nozzle for defining the first and second delivery channels.

6. The apparatus of claim 1 further including a plurality of nozzle elements formed in a substrate.

* * * * *